United States Patent [19]

Tagawa

[11] 4,196,862

[45] Apr. 8, 1980

[54] APPARATUS FOR CRUSHING BUILDING MATERIALS

[76] Inventor: Ituo Tagawa, 10-6, Akabane-nishi 6 chome, Kita-ku, Tokyo, Japan

[21] Appl. No.: 939,935

[22] Filed: Sep. 6, 1978

[51] Int. Cl.[2] ..... B02C 1/06; B02C 1/10

[52] U.S. Cl. ..... 241/266; 241/101.7; 299/70

[58] Field of Search ..... 225/103; 125/23 R; 299/14, 15, 69, 70; 241/101.7, 263–269, 283

[56] References Cited

U.S. PATENT DOCUMENTS 3,079,096 2/1963 McConnell ..... 241/266 X

FOREIGN PATENT DOCUMENTS 2340188 3/1974 Fed. Rep. of Germany ..... 241/101.7

*Primary Examiner*—Mark Rosenbaum

*Attorney, Agent, or Firm*—Sughrue, Rothwell, Mion, Zinn and Macpeak

[57] ABSTRACT

Apparatus for crushing building materials such as concrete blocks with a uniform pressure. Crushing jaws are separately pivotably attached to side support plates in a disclosed manner so that no shock forces produced during crushing are transmitted to a supporting boom. Water is sprayed on an object as it is crushed to prevent the spread of dust produced during crushing into the atmosphere.

5 Claims, 5 Drawing Figures

APPARATUS FOR CRUSHING BUILDING MATERIALS

BACKGROUND OF THE INVENTION

The invention relates to apparatus for crushing concrete and other such building materials by means of pressure and more specifically to apparatus for crushing building materials which may be installed on a working vehicle such as a tractor.

Apparatus for crushing building materials by means of pressure is presently in use. In the prior art apparatus, a concrete body to be crushed was interposed between a stationary blade and a movable blade and pressure applied through the movable blade. The reaction generated from crushing the materials was transmitted to the working vehicle through support members and fitting members such as booms of the apparatus frequently resulting in danger to the operator.

As the stroke of the moving blade of such apparatus is increased, the apparatus must necessarily become larger and heavier in comparison to its crushing capacity. Since oscillation as well as noise are great during crushing work, environmental noise pollution problems occurred. This is an especially serious concern in a hospital district or in a residential neighborhood.

SUMMARY OF THE INVENTION

An object of the present invention is to provide apparatus in which a pair of jaw members for clamping and pressing an object to be crushed bite and clamp the object with a uniform pressure.

It is another object of the present invention to provide apparatus in which jaw members performing the opening and closing actions are constructed so as to easily receive an object to be crushed and consequently has high maneuverability and high crushing efficiency.

It is still another object of the present invention to prevent the reaction of clamping and crushing pressure of jaw members from being transmitted through a working vehicle and to minimize the vibration or noise occurring during crushing. It is still another object of the present invention to provide apparatus which eliminates dispersal of dust generated at the time of crushing and accordingly prevents atmospheric pollution at the working site.

Apparatus in accordance with the present invention is characterized in that a pair of jaw members are pivoted between two side support plates at different support points and in that both of the jaw members are capable of moving and turning.

Apparatus of the invention is further characterized in that the mounting angle of said side support plates is adjustable with respect to booms and further that such apparatus is equipped with a device for spraying water, either constantly or intermittently, from positions near pivots of the jaw members towards the tip of the members.

DESCRIPTION OF THE PREFERRED EMBODIMENT

An embodiment of apparatus constructed in accordance with the invention will now be described with reference to the accompanying drawings.

Figure 1:
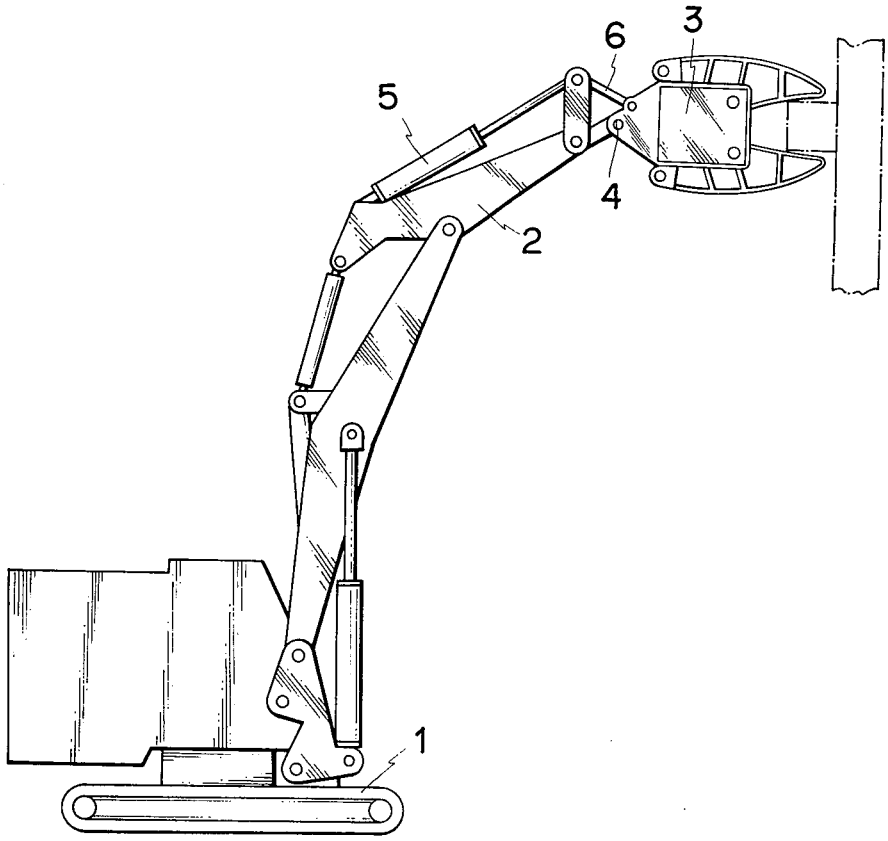
FIG. 1 is a side view of apparatus of the present invention operated with a working vehicle.

FIG. 1 is a schematic view showing apparatus embodying the invention in which a portion of the apparatus is shown enlarged. Reference numeral 1 designates a working vehicle, 2 a boom capable of swivelling and revolving, 3 crushing apparatus mounted at the tip of the boom and allowed to revolve in the vertical direction, 5 a driving cylinder, and 6 a link.

Figure 2:
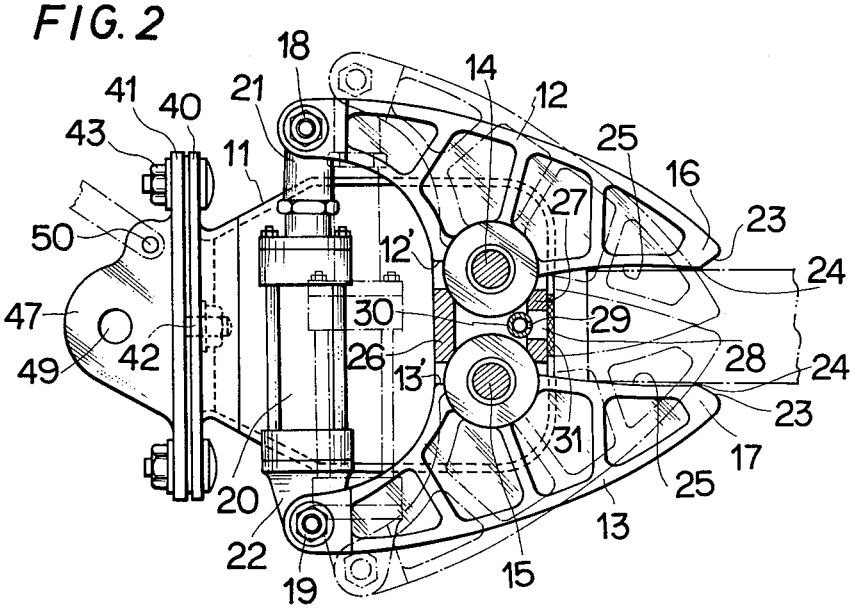
FIG. 2 is a partially sectional view of the apparatus showing the mounting angle adjusting mechanism in which the side surface on the base side is deleted.
Figure 3:
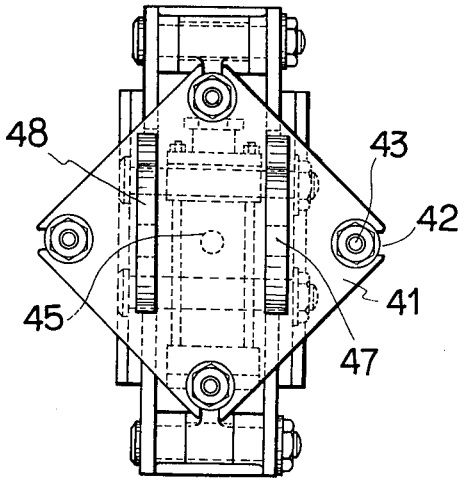
FIG. 3 is a rear view of the apparatus of FIG. 2.
Figure 4:
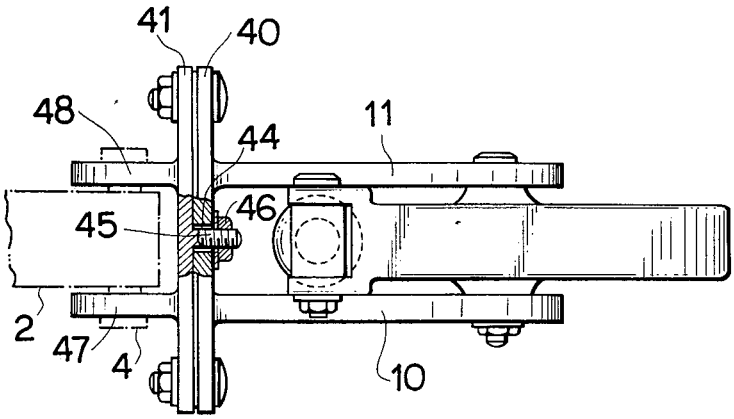
FIG. 4 is a partially cut-away top view of the apparatus of FIG. 2.
Figure 5:
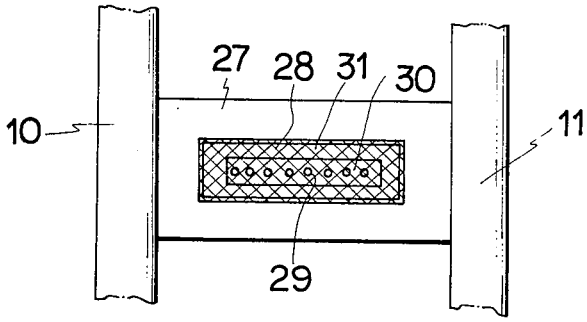
FIG. 5 is an enlarged plan view of the water spraying device used with the invention.

Crushing apparatus 3 is shown in detail in FIGS. 2–4. Reference numerals 10 and 11 designate two side support plates that oppose each other while interposing a pair of jaw members 12 and 13 between them. Jaw members 12 and 13 have an arcuate form around their outer periphery and are generally fan-shaped. They are rotatably pivoted about pivots 14 and 15 at their center with pivots 14 and 15 extending through the above-mentioned side support plates. Rear ends 18 and 19 of each jaw member are each connected by pins to the end of piston rod 21 which extends from hydraulic cylinder 20 and also to clevis 22.

Reference numerals 16 and 17 represent the tip biting section of the jaw members 12 and 13, respectively. At the front end of the biting section is formed a bite-guide slanted surface 23 and a protruding tooth 24 formed as a slight protuberance on slanted surface 23. If desired a ridge 25 may be provided lengthwise on the inner surface of each jaw opposite one another.

Reinforcing member 26 reinforces two side support plates 10 and 11 against a torsional force acting therebetween. Reinforcing member 26 also functions as a stop to restrict the opening range of jaw members 12 and 13. Side plate reinforcing member 27 is secured in front of pivots 14 and 15 and functions also as a stopper when jaw members 12 and 13 are closed. The mounting positions of front and rear reinforcing members 26 and 27 are optional.

A window 28 is formed on the front reinforcing plate 27 and water pipe 30 having a water spray port 29 is positioned at the rear of plate 27. A protective mesh 31 covers window 28. The base end of support slide plates 10 and 11 may be pivotably coupled to the end of boom 2 as shown in FIG. 1.

In order to adjust the mounting angle of the apparatus to the boom, an angle adjusting device such as shown in FIGS. 2–4 may be provided so as to improve the flexibility of operation of the apparatus to a marked extent. To accomplish this, the two support side plates are each split at their base end flanges 40 and 41 into two portions which are integrally connected to each other at the portion corresponding to the split surface, that is, on the opposed surface. At least four bolt holes or slots 42 are formed at symmetric positions around the flange so that the angle adjusting device may be detachably fastened by means of bolts 43.

In this case, a stud may be positioned at the center of one of flanges 40 and 41 and fitted into a mating hole at the center of the other flange to thereby form a pivot 45 for swivelling as shown in FIG. 4. Otherwise, the stud may be replaced by a bolt. This construction is more convenient for fitting and removal of the above-mentioned bolt 43 at the time of angle adjustment of the flanges.

Fitting lugs 47 and 48 are provided which correspond to the base end of side support plates 10 and 11. A boomfitting hole 49 is also provided.

The mode of use of the apparatus having the above-mentioned construction is as follows.

First, hydraulic cylinder 20 retracts piston rod 21 so that tips 16 and 17 of jaw members 12 and 13 are opened permitting them to receive and grasp an object to be crushed at their biting section. When jaw members 12 and 13 are opened, at least one of stepped sections 12' and 13' of jaw members 12 and 13 abuts reinforcing member or stop 26 and thus restricting the position of opening of jaw members 12 and 13. Hence, jaw members 12 and 13 in the open state do not oscillate during biting operation thus ensuring proper biting performance.

After the object to be crushed is grasped, piston rod 21 is extended causing a large compressional force which crushes the grasped object. During crushing, jaw members 12 and 13 receive a large reactive force. However, since the pair of jaw members in the apparatus of the present invention are not secured to the side support plates but remain free, no reactive force at all is transmitted to the boom and working vehicle.

Dust generated during the crushing operation is adsorbed by water that is sprayed onto the object as it is crushed. Hence, pollution of the atmosphere caused by dust particles produced during the crushing operation is substantially eliminated.

In the apparatus of the present invention, the crushing operation is carried out sequentially by opening of jaw members 12 and 13 grasping the object to be crushed, and biting the object with jaw members 12 and 13 thereby crushing the object from its outside to the inside. Hence, neither vibration nor noise is generated during crushing. Also, it is an advantage that with the invention that after crushing, remnants which fall to the ground are small enough so that they can be transported without further crushing.

As buildings are generally constructed using horizontal beams and perpendicular poles, it is necessary to be able to change the orientation of the biting surface of the jaw members. This can be accomplished by removing lock bolt 43 while the apparatus as a whole remains stationary, then orienting side support plates 10 and 11 to a desired angle such as 90°, for example, and again fastening the flanges by lock bolt 43. During the angle adjustment, the upper one of side support plates, 10 and 11, is suspended by the swivel shaft 45. Though the angle adjustment of the biting surface may be effected by other mechanisms, the above-mentioned example represents a simplified mechanism which does not increase the weight of the apparatus itself.

Although preferred embodiments of the invention have been described, it is believed that numerous modifications and alterations thereto would be apparent to one having ordinary skill in the art without departing from the spirit and scope of the invention.

What is claimed is:

1. Apparatus for crushing objects such as building materials by interposing an object to be crushed between two pressing members and crushing the object with pressure and adapted to be mounted on a boom of a working vehicle, said crushing apparatus comprising;

a pair of parallel side support plates;

a pair of parallel jaw members interposed between said side support plates;

first and second pivot members extending through said side support plates with each of said jaw members being pivotally mounted at its center portion about a respective one of said pivot members;

a hydraulic cylinder having a piston rod extending from one end thereof operatively positioned between rear ends of said jaw members to move both said jaw members about said pivot members; each of said jaw members having a bitting and crushing section at its front end including a bite-guide slanted surface and a protruding tooth formed as a slight protuberance on said slanted surface; and a mounting support, said side support plates each having a base end at their rear portions, the two base ends each being coupled to said mounting support.

2. The crushing apparatus as defined in claim 1 further comprising a water spraying device for spraying water between said side support plates towards the biting surfaces of said jaw members.

3. The crushing apparatus as defined in claim 1 further comprising a stop/support reinforcing plate disposed at the back of said pivot members in order to prevent movement of said jaw members while in the open state.

4. The crushing apparatus as defined in either of claims 1 or 3 further comprising a mounting angle adjusting device on the base ends of said side support plates.

5. The crushing apparatus as defined in claim 4 wherein said mounting angle adjusting device comprises two opposed flanges having a swivel shaft at their center and a lock bolt.

* * * * *